United States Patent [19]

Eckert

[11] 4,247,010

[45] Jan. 27, 1981

[54] DISPLAY STAND AND METHOD OF MAKING SAME

[75] Inventor: Ronald P. Eckert, Northbrook, Ill.

[73] Assignee: DLM, Inc., Niles, Ill.

[21] Appl. No.: 931,834

[22] Filed: Aug. 7, 1978

[51] Int. Cl.[3] ..... A47F 5/00

[52] U.S. Cl. ..... 211/131; 211/163

[58] Field of Search ..... 211/131, 163, 129, 56, 211/58, 78; 312/128, 135

[56] References Cited

U.S. PATENT DOCUMENTS

| | | | |
|---|---|---|---|
| 766,629 | 8/1904 | Koehler . | |
| 1,103,100 | 7/1914 | Thompson . | |
| 1,767,980 | 6/1930 | Hintze . | |
| 2,493,538 | 1/1950 | Karns . | |
| 2,614,698 | 10/1952 | Bell | 211/62 |
| 2,755,583 | 7/1956 | Loeb | 211/163 X |
| 3,498,471 | 3/1970 | Dirkx | 211/131 |
| 3,543,699 | 12/1970 | Lelkarts | 211/131 X |
| 3,543,943 | 12/1970 | Joy et al. | 211/131 |

*Primary Examiner*—Roy D. Frazier
*Assistant Examiner*—Robert W. Gibson, Jr.
*Attorney, Agent, or Firm*—Wegner, Stellman, McCord, Wood & Dalton

[57] ABSTRACT

A display stand for displaying flat articles on edge, such as greeting cards and the like, has a base and a vertical column to which is assembled one or more tiers of upwardly angled housings having card-receiving pockets. Each tier has multiples of two housings located diametrically opposite each other on a mounting web, such that when four, six or eight housings are provided, the housings are equally spaced apart circumferentially by abutments on said webs. Each web has a column-engaging hub of reduced axial length which interfits with an axially displaced hub on an adjacent web to present a continuous axial hub to the column throughout the axial height of said tier. Tabs project upward and downward from each housing to interfit with tabs on housings on a tier above and/or below said housing. Each housing has a divider to make two pockets therein with openings in the lower corner of each pocket to permit dust and the like to fall out. A method of assembling each pair of housings, each tier of housings and each stack of tiers of housings is included.

23 Claims, 8 Drawing Figures

DISPLAY STAND AND METHOD OF MAKING SAME

BACKGROUND OF THE INVENTION

1. Field of the Invention

This invention relates to display stands and, in particular, to a tiered stand for displaying a plurality of flat articles, such as greeting cards, and the like.

2. Description of the Prior Art

Flat articles, such as greeting cards, and the like, are generally displayed in a vertical rack with the face of each card facing forward. The rack is subdivided into a plurality of cubicles or pigeonholes into each one of which is stacked a different greeting card. A rack of this type takes up considerable floor and wall space and often requires that some cards be stored very low or very high on the rack making it very difficult to observe them by persons above or below average height. As the number of greeting cards being displayed increases, space limitations take over and prevent adequately displaying all of the cards available, thus reducing sales. A typical rack of the type just described is shown in the Jonathan et al U.S. Pat. No. 3,886,348.

Attempts have been made to overcome the problems of the flat, vertical display rack by stacking pockets on vertical supports, which supports are mounted on a rotatable stand. One such device is shown by Thompson in U.S. Pat. NO. 1,103,100 wherein a stand with a cross-shaped frame and plural supports extend upwardly therefrom. Individual paired channels forming pockets are vertically and circumferentially spaced on each support thereby increasing the number of cards that can be displayed for the amount of floor space available. Similar devices were shown by Hintze U.S. Pat. NO. 1,767,980 and Koehler U.S. Pat. No. 766,629. However, in each of these cases, only a limited number of cards can be displayed in each pocket and the pockets are located in such a way that access thereto is difficult and time consuming. The cards were either too exposed, such as in the Thompson U.S. Pat. No. 1,103,100, or were too covered as in the Hintze U.S. Pat. No. 1,767,980.

SUMMARY OF THE INVENTION

The present invention overcomes many of the problems inherent in the previous systems for displaying flat objects, such as greeting cards, to their maximum ability. My improved display stand has a base with an upstanding column upon which is assembled one or more tiers of upwardly and outwardly projecting housings containing pockets for storing stacks of greeting cards or the like. Each tier is made up of one or more pairs of units with each unit having a pair of oppositely disposed upwardly and outwardly projecting housings on the opposite ends thereof. Each unit also has abutment means and hub means, which hub means have an axial length one over n (1/n) times the axial length of each unit where n equals the number of units in each tier. The hubs of the units of each tier are stacked one on top of the other in juxtaposed relationship when the units are assembled on the column.

Each hub has guides and bearing members for assisting in assembling and rotating the units with respect to the column. Each housing has a divider for creating at least two pockets therein with dust removing openings in the lower portion of each pocket.

I have also invented a method of assembling a display stand having a base and a column with one or more tiers of housings thereon. Each tier has at least one unit comprising a web with two half housings on the outer end portions an a half hub in the midportion such that when two webs are assembled face-to-face, a unit is created having two housings on the opposite ends thereof and a hub in the midportion. A divider is trapped between the two half housings to divide each housing into a pair of pockets. The axial length of each hub of each unit is coordinated with the axial length of the hubs of other units in the tier so that when all of the units are assembled together in a tier, the axial length of the hub engaging the column is substantially equal to the axial length of the tier.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
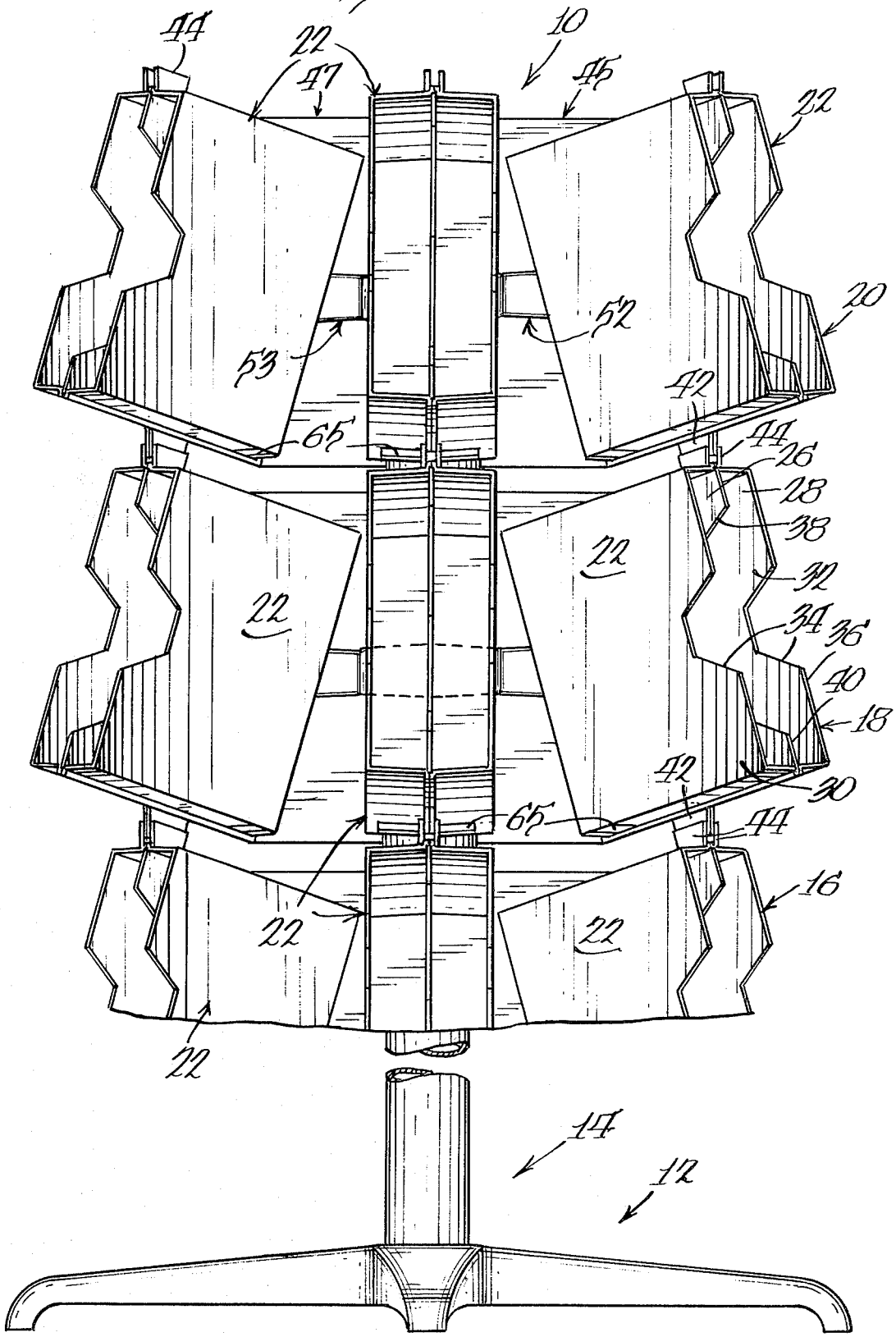
FIG. 1 is a partial elevational view of a column having two and one-half tiers assembled therewith, portions of one tier and of the column are broken away.

Referring to the drawings, a display stand 10 is shown having a base 12 and an upstanding column 14. In FIG. 1, the column 14 could extend above the uppermost tier of the stand 10 with a head or cap portion (not shown) seated thereon. The head or cap portion could carry advertising, could include a light to illuminate the display thereon, or the like. Assembled on the column 14 is a plurality of tiers 16, 18 and 20 of housings 22. Each housing 22, in broad context, is made up of a preferable transparent plastic material and will have a divider 24 which divides each housing 22 into two pockets 26 and 28. The outer vertical walls 30 and 32 of each pocket, have finger cutouts 34 formed substantially midway along the front edge 36 of the housing 22. The dividers 24 will have a deeper or more pronounced cutout 38 formed in the outwardly facing edge 40 thereof. As is shown generally in FIG. 1, each tier 16, 18 and 20 has, on each housing, vertically aligned tabs 42 and 44 with the tabs 42 abutting each other and projecting downwardly into the opening between spaced apart, upwardly spacing tabs 44 on the immediately below housing 22. The tabs 42 on the lower portion of a housing 22 are vertically aligned with the upwardly extending tabs 44 on the upper portion of each housing 22, which will result in the upper tabs 44 being located closer to the opening into the front of each housing than the downwardly extending tabs 42. From FIG. 1, it can be seen that one, two, three or more tiers of housings can be provided as desired without departing from the spirit of the invention.

Figure 2:
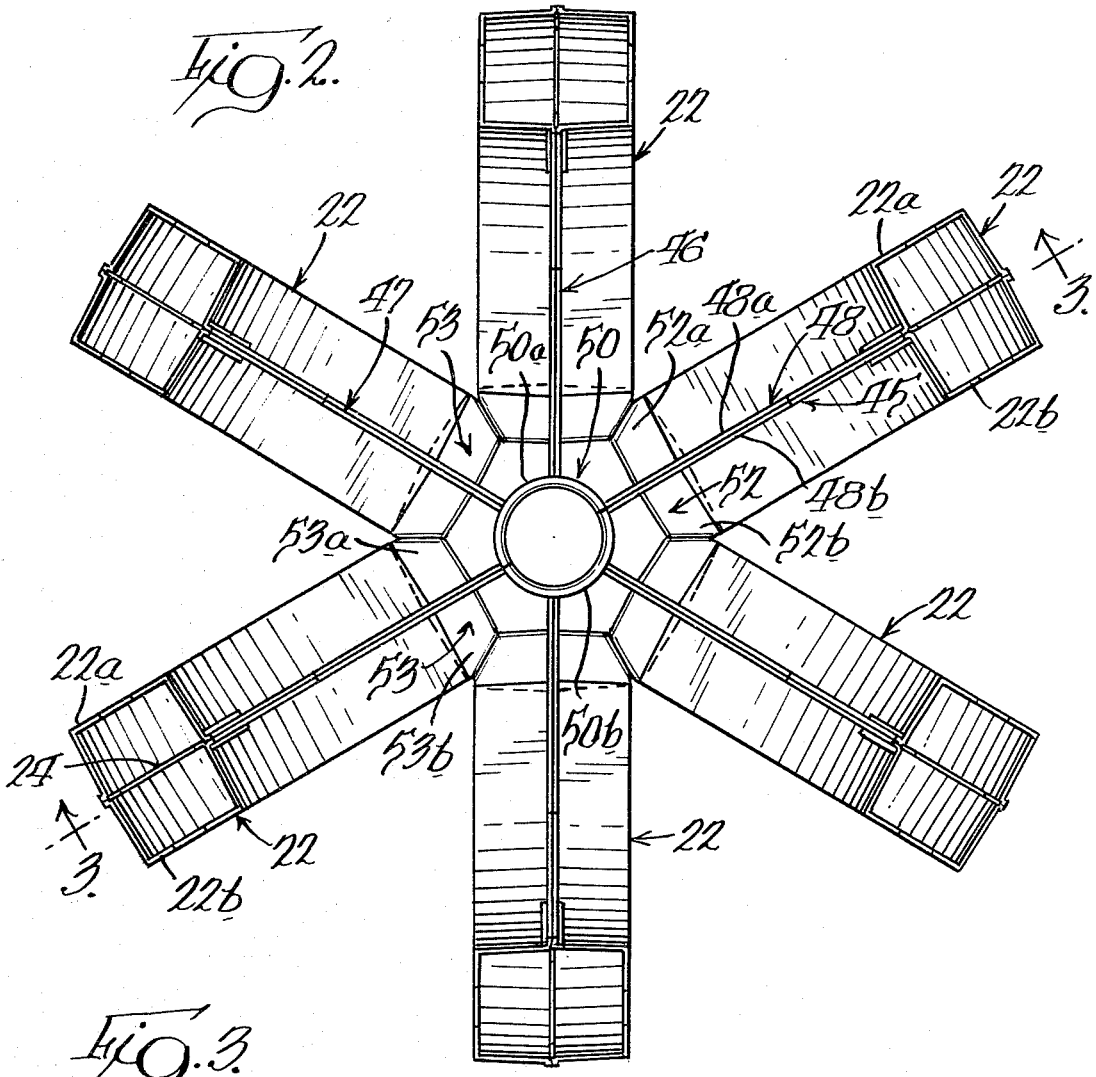
FIG. 2 is a top plan view of the display stand of FIG. 1.
Figure 3:
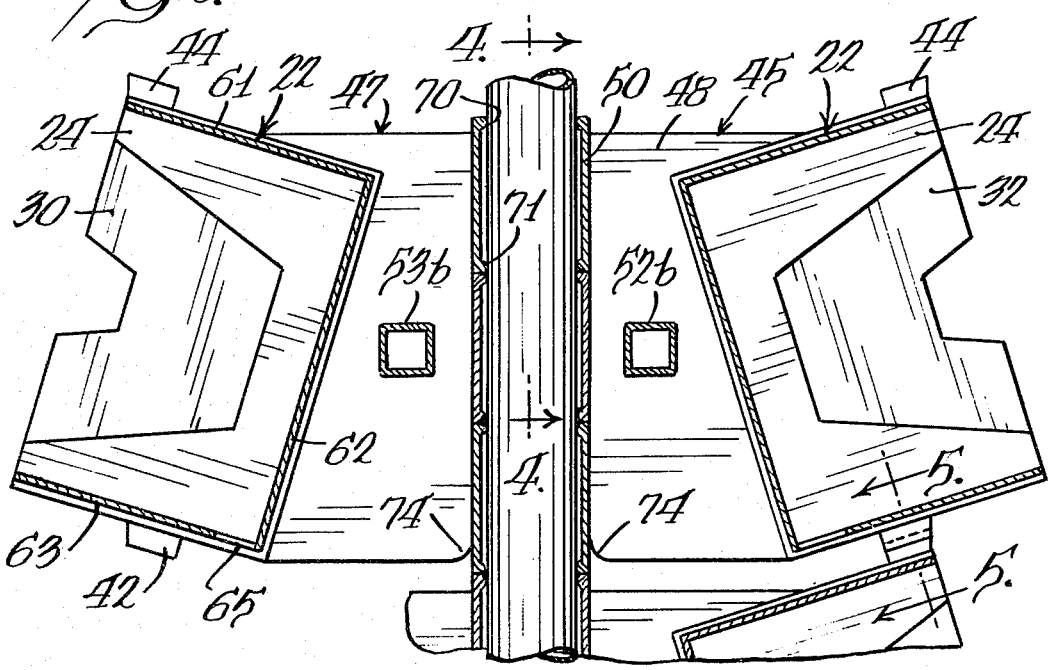
FIG. 3 is a cross-sectional view taken along the line 3—3 of FIG. 2.
Figure 6:
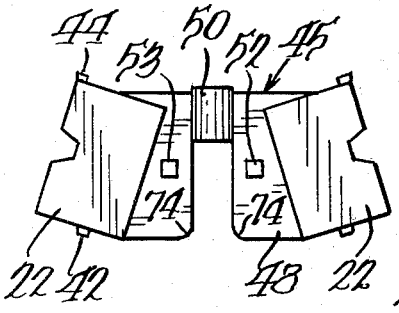
FIGS. 6, 7 and 8 are three units making up one tier showing the locations of the hubs for each unit of one tier, FIG. 6 showing the hub at the upper portion of the web, FIG. 7 showing the hub at the midportion of the web, and FIG. 8 showing the hub at the lower portion of the web.
Figure 7:
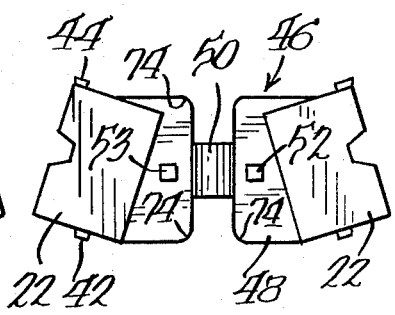

Going now more into the details of the construction of each tier of the display stand 10, I will refer more generally to FIG. 1, but closely to FIGS. 2 through 5 with general reference to FIGS. 6 and 7. In the form of invention illustrated, the display stand 10 will have each tier 16, 18 and 20 made up of three units 45, 46 and 47 with each unit having a web 48, a hub 50, two pairs of oppositely facing abutments 52 and 53 on said web and a pair of housings 22 at each end of the web. Each unit, such as unit 45, which is shown in FIG. 3, is formed in two halves with one half comprising a web 48*a* connected to a one-half hub 50*a* and connected to a shaped half housing 22*a*. The other half 48*b* has a half hub 50*b* and half housing 22*b*. Web 48*a* has a pair of transversely extending abutments 52*a* and 53*a* located on opposite sides of the half hub 50*a* while web 48*b* has a pair of transversely extending abutments 52*b* and 53*b* on opposite sides of said hub 50*b*. As can best be seen in FIG. 5, the mating surfaces of each shaped half housing 22*a* and 22*b* have mating grooves or undercuts 58,59 to receive the edges of a divider 24. The undercut 59 is radially longer than undercut 58 such that a positioning rib 60 projecting outwardly from the edge of undercut 58 will seat in the undercut 59 with the divider 24 nesting in the undercut 58 with the planar centerline of the divider 24 coinciding with the mating planar faces of each half 22*a*, 22*b*. Appropriate solvent or other adhesive is applied to the mating surfaces of the webs 48 and mating edges and undercuts 58,59 of the halves 22*a*,22*b* whereupon a divider 24 is positioned in the undercuts of each half housing so that when the two webs 48 are brought together, the two halves 22*a*, 22*b* of the housing 22 trap the divider 24 in each housing to divide each housing into a pair of pockets 26 and 28 and the half hubs 50*a* and 50*b* will mate to form the hub 50.

Each half housing has downwardly extending tabs 42 and upwardly extending tabs 44 vertically aligned along an axis lying parallel to the axis of the hub 50. The downward tabs 42 are aligned with the substantial edge of each half so that when the halves 22*a*, 22*b* of the housing 22 are brought together, the tabs 42 will abut face-to-face. The upwardly extending tabs 44 are spaced a short distance away from the parting line of the halves 22*a* and 22*b* of the housing 22 so that when the two halves of the housing are assembled together, there will be a space 43 between the upper tabs 44 which space 43 will be slightly larger than the thickness of the two downwardly depending tabs 42. When two tiers 16,18 are stacked on the column 14, each housing will have downwardly depending tabs 42 fitting between the upwardly extending tabs 44.

Each housing 22 has an upper wall 61, a rear wall 62 and a lower wall 63 to go along with the side walls 30 and 32. The lower wall 63 will have a cutout portion 65 near the lower rear corner of the housing, so that each pocket 26 and 28 has the lowest corner of the pocket at least partially open so that any dust or other foreign matter that gets in the pocket will immediately drop through the opening 65.

The two pairs of abutments 52*a* and 53*a* and 52*b* and 53*b*, which extend transversely from the opposite sides of the webs 48 of each unit, extend outwardly from the web a distance substantially equal to the width of the half housings 22*a* or 22*b*. The outer face of the abutments 52*a*,53*a* have an angle of approximately 30° to the plane of the web 48 so that, as can be seen in FIG. 2, when two units 45,46 or 46,47 of a three-unit system are assembled side-by-side, the abutting faces of adjacent abutments 52*a*,53*a* will be flat with respect to each other for spacing the outwardly extending housings 22 from each other with an angle of 60° between the webs of adjacent units. Although the abutments 52*a*,52*b* and 53*a*,53*b* are shown rectangular or square in cross section, it should be clear that the abutments could be circular or elliptical or of any other cross-sectional configuration without departing from the spirit of the invention.

Figure 4:
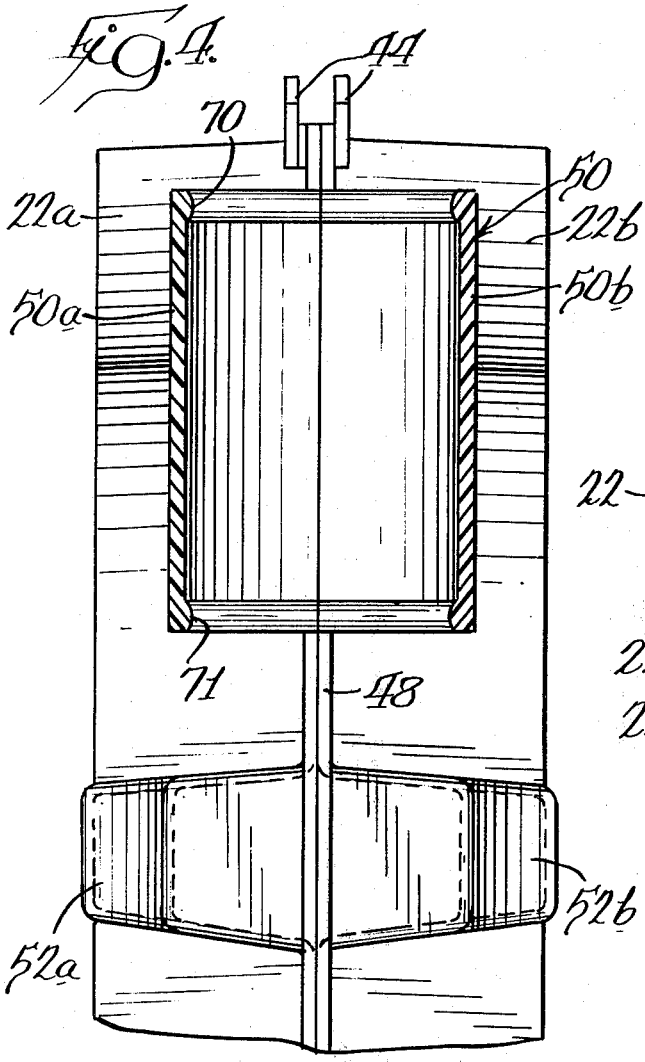
FIG. 4 is a cross-sectional view taken along the line 4—4 of FIG. 3.
Figure 5:
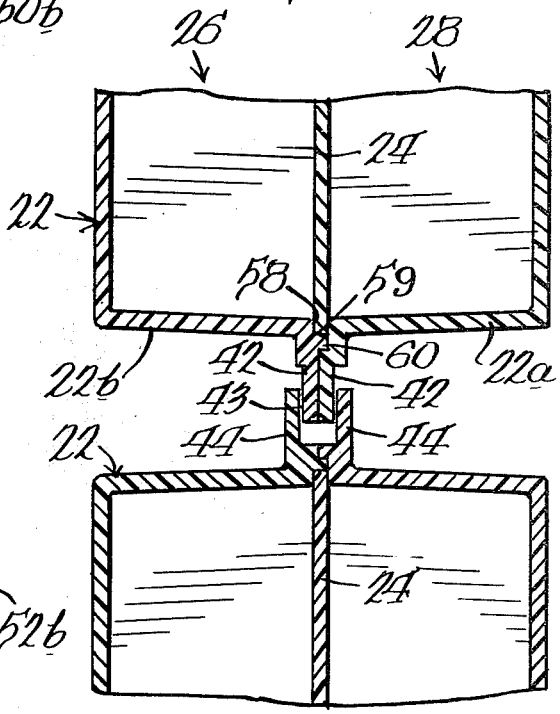
FIG. 5 is an enlarged cross-sectional view taken along the line 5—5 of FIG. 3.
Figure 8:
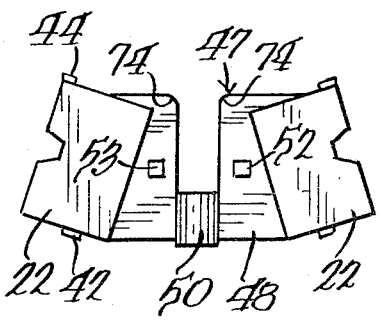

To provide proper support for the housings on each unit of a tier and so as to make it possible to have the units of each tier as relatively simple as possible, it has been found that the axial length of the hub of each unit of a tier will be determined by the number of units in a tier. In the form of invention illustrated, there are three units 45,46,47 to a tier 16,18 or 20 so that the axial length of the hub 50 of each unit in a tier will be one-third the axial length of the web 48 of the unit. This is best illustrated in FIGS. 6, 7 and 8 wherein unit 45 is illustrated in FIG. 6, unit 46 is illustrated in FIG. 7 and unit 47 is illustrated in FIG. 8. Unit 45, which is the same unit as is illustrated in FIGS. 3 and 4, has the hub 50 integrally formed with the web 48 at the upper third of the web 48. Unit 46, FIG. 7, is shown with the hub 50 integrally formed with the web 48 at the axial midportion of the web 48 and unit 47, FIG. 8, has the hub 50 integrally formed with the web 48 along the lower third portion of the web 48, such that in assembling a tier on the column 14 of the stand 10, the unit 47 will first be assembled over the top of the column, next a unit 46 would be assembled over the column of the unit with the hub brought down into contact with the upper end of the hub 50 of unit 47 and, finally, unit 45 would be assembled over the end of the column with the hub 50 brought into registry with the open space between the abutments 52,53 of juxtaposed units 46 and 47 with the lower portion of the hub 50 bearing against the upper portion of the hub 50 of unit 46. In this way, the three hubs 50 of units 45,46 and 47 would combine to form a hub extending substantially the full length of the tier and with the abutments 52 and 53 of each unit 45,46 and 47 abutting adjacent abutments 52 and 53 so that the units are uniformally spaced apart and held substantially rigid with respect to each other to form a tier.

Each hub 50, as shown in FIGS. 3,4, has inwwardly directed continuous ledges or ridges 70,71 formed at the opposite ends on the internal surface of the hub 50 so as to present a substantially line contact with the column 14 passing through the center of the hub. Each ledge or ridge 70,71 is rounded in vertical cross section so as to present a wider mouth or guide for entry of the column into the opening in the hub. The webs 48 on each unit will have openings above or below the hub with the exposed corners of the web at the openings being rounded as at 74 so as to act as guides for the column and for the hubs 50 of adjacent units. That is, as shown in FIGS. 3, 6 and 7, the lower corners 74 of the webs 48 are rounded such that when the units 45,47 are assembled on the column 14, the top of the column can be guided by the rounded corners 74 on the webs and the rounded corners can engage with the hubs of the next lower unit to center the unit and the hubs relative to the adjacent unit and hub. The web of unit 46 has rounded corners at the top as well as at the bottom corner of the opening and the web of unit 47 has a rounded corner 74 at the top corner of the opening which rounded corners act as guides for assembling the webs on the column.

As is illustrated in FIG. 3, each housing 22 is integrally formed with the web 48 and is oriented to tilt upwardly and outwardly with respect to a centerline through the hubs 50 of the web. This will present the open mouth of the housing in a tilted position to prevent the cards from falling out of the pockets 26,28 in each housing. The angle between the housing and the axis of the hub is as small as possible so as to hold the cards nested in the pockets and, at the same time, not to tilt the cards to a point as to make it difficult to read the message or to see the illustration on the face of the card through the transparent walls of the housing. Each pocket is made of an appropriate width so as to hold approximately one dozen greeting cards and envelopes, or can be made of a width to accommodate possible 18 cards and envelopes such that when the cards reach the six count level, it will be a notification to the owner to replenish the cards in that pocket.

When it is desired to assemble a display stand, it must first be decided how many tiers 16, 18, 20 the stand will have. The column of the stand is then adjusted accordingly. Each tier is bult up as previously described, namely by using a unit 47 first, unit 46 next and unit 45 last and interfitting the hubs 50 and webs 48 with the abutments 52,53 on each web in contact with the abutments 52,53 on the adjacent webs to form the tier. The next tier is assembled the same way on top of the first tier only as each unit is assembled, the tabs 42 on each housing 22 are nested in the spaced tabs 44 on the immediately below housing. In this way, the tiers are locked relative to each other, but will rotate together in the event appropriate pressure is applied to a housing on one tier. When the desired number of tiers of housings have been assembled, a cap or head may be placed on the top of the column and the stand is ready for loading and use.

My unique display stand is adapted for use with any multiples of two housings per tier desired. That is, it is possible to have just one unit per tier which means that one pair of oppositely facing housings will be located on each tier, in which case the hub would extend the full length of the web of that unit. In the event it is desired to have four housings per tier, the axial length of the hub will be calculated by one over n (1/n) where n equals the number of units in a tier. With four housings, there will be two units and, therefore, the axial length of the hubs will be one over 2 (½) times the axial length of the tier with the hub of one unit being on the upper half of the web and the hub on the other unit being at the lower half of the web. Likewise, if it is desired to have eight housings on a tier, the axial length of the hub on each unit will be determined by one over four units times the axial length of the unit or one-fourth the axial length of the unit. The hubs will be positioned along the respective webs of the units in the tier so that when the hubs are assembled together, one on top of the other, the unit will have one hub extending the axial length of the unit.

The cutouts in the side walls of each housing and the cutout in the divider between the housing makes it possible to readily grasp the desired card and envelope to remove it from the pocket.

I have also invented a novel method of assembling a unit and a tier wherein each unit 45,46,47 is made up by taking a web 48 having integrally molded half housings *22a,22a* at the outer ends thereof and an integrally formed hub member *50a* at the center thereof. A second web 48 with oppositely facing half housings *22b,22b* at the outer ends thereof and an oppositely facing hub half *50b* at the center thereof is aligned with the first web and associated parts. A divider 24 is placed in undercuts 58,59 formed in the facing halves *22a,22b* of the respective housings. Appropriate solvent or adhesive is applied to the webs and the housing edges and the hub edges and the two halves are brought together to form a unit. One unit 47 having a hub 50 at the lower portion of the web 48 is assembled with a second unit 46 having a hub 50 formed at an intermediate portion of the web 48 thereof, which in turn is assembled with a third unit 45 having a hub 50 formed at the upper portion of the web 48 with all three units 45,46,47 interfitting and having abutments 52,53 on each web 48 engaging with abutments 52,53 on the adjacent webs 48 so as to form a tier. One or more tiers can then be assembled with a column to form a display stand.

What is claimed is:

1. A display stand comprising a base having a vertical column, at least one tier of radially outwardly and upwardly tilted housings carried by said column, each said tier comprising a plurality of interfitting units, each unit having a web with a pair of housings on opposite ends thereof, two pairs of oppositely extending abutments carried by each unit, a hub carried by each web midway between said pair of housings, said hub having an axial length equal to 1/n times the axial length of said web where n equals the number of units in said tier, each said hub being located on its respective web in an axially spaced relation with each other hub in said tier such that the sum of the axial lengths of said hubs when juxtaposed on said column in each tier will equal the axial length of said webs whereby stacking said units with the hubs and associated webs will register the abutments with each other to equally space said housings apart circumferentially in said tier.

2. A display stand as claimed in claim 1 wherein at least two tiers of housings are carried by said column and tabs project from at least one housing in one tier to interfit with tabs carried by an aligned housing in the vertically adjacent tier to orient the housings in one tier relative to the housings in the next tier.

3. A display stand as claimed in claim 1 wherein dividers are assembled in grooves formed in each housing to divide each housing into two pockets.

4. A display stand as claimed in claim 3 wherein openings are formed in lower rear corners of each pocket to permit dust and the like to escape from said pocket.

5. A display stand as claimed in claim 1 wherein each hub has an inwardly directed bearing ledge formed at each end thereof to provide substantially line contact with said column at each end of said hub.

6. A display stand as claimed in claim 1 wherein the web of each pair of housings is open at the midportions thereof above and/or below said hub with the corners of the web at the opening being curved to guide said web into the column and over the hubs of any immediately adjacent webs in said tier.

7. A display stand as claimed in claim 3 wherein each said divider and the outside walls of each housing have cutout finger openings to assist in grasping an article in the pocket.

8. A method of assembling a tier of housings on a column comprising the steps of aligning two webs having a half hub in the midportion and a half shaped housing on each end thereof, inserting a divider into a groove formed around the facing edges of said half housings, sealing said webs, divider, half hubs and shaped half housings together to form a first pair of housings, threading the column through said hub on said first pair of housings, assembling a second pair of webs, divider, half hubs and half housings together to form a second pair of housings only with the hub being spaced axially from the hub of said first pair of housings, threading the column through said hub on said second web with said hub juxtaposed on the column above the hub of the first web, and assembling a third pair of webs, divider, half hubs and half housings together to form a third pair of housings only with the hub spaced axially from the hubs of the first and second pair of housings, and threading said column through said hub on said third pair of housings with the three hubs juxtaposed on the column and with the housings all equally spaced apart to form a tier on said column.

9. A method as claimed in claim 8 wherein at least two tiers are assembled on the column with tabs on one tier nesting in tabs on the other tier.

10. A display stand structure comprising a base having a vertical column, at least one tier of radially outwardly and upwardly tilted housings carried by said column, each said tier comprising a plurality of interfitting units, each unit having a web with a housing on each end thereof, a hub carried by each web midway between said housing, said hub having an axial length equal to 1/n times the axial length of said web where n equals the number of units in said tier, the hub on each unit being located on its respective web in an axially spaced relation with each other hub in said tier such that the sum of the axial lengths of said hubs when juxtaposed on said column in each tier will equal the axial length of said webs.

11. A display stand as claimed in claim 10 wherein at least two tiers of housings are carried by said column and tabs project from at least one housing in one tier to interfit with tabs carried by at least one housing in the adjacent tier to fix the housings in one tier relative to the housings in the next tier.

12. A display stand as claimed in claim 10 wherein dividers are assembled in each housing to divide each housing into two pockets.

13. A display stand as claimed in claim 12 wherein openings are formed in lower portions of each pocket to permit dust and the like escape from said pocket.

14. A display stand as claimed in claim 10 wherein each hub has an inwardly directed bearing ledge formed at each end thereof to provide substantially line contact with said column at each end of said hub.

15. A display stand as claimed in claim 10 wherein the web of each unit has openings at the midportions thereof above, below or on both sides of said hub with the corners of said openings being curved to guide said web onto the column and over the hubs of adjacent webs in said tier.

16. A display stand comprising a base having a vertical column, at least one tier of radially outwardly and upwardly tilted transparent housings carried by said column, each said tier comprising a plurality of interfitting units, each unit having a web with a pair of said housings on opposite ends thereof, a hub carried by each web midway between said housings, and oppositely extending abutments carried by each web substantially midway between said hub and each one of said housings whereby stacking said units with the hubs encircling said column will register the abutments on one web with abutments on adjacent webs to equally space said housings apart circumferentialy in said tier.

17. A display stand as claimed in claim 16 wherein at least two tiers of housings are carried by said column and tabs project from at least one housing in one tier to interfit with tabs carried by an aligned housing in the vertically adjacent tier to orient the housings in one tier relative to the housings in the next tier.

18. A display stand as claimed in claim 16 wherein dividers are assembled in grooves formed in each housing to divide each housing into two pockets.

19. A display stand as claimed in claim 18 wherein said dividers are transparent and have cutout front edges to facilitate grasping a flat article in one of said pockets.

20. A display stand as claimed in claim 18 wherein openings are formed in lower rear corners of each pocket to permit dust and the like to escape from said pocket.

21. A display stand as claimed in claim 16 wherein each hub has an inwardly directed bearing ledge formed at each end thereof to provide substantially line contact with said column at each end of said hub.

22. A display stand as claimed in claim 16 wherein the web of each pair of housings is open at the midportions thereof above and/or below said hub with the corners of the web at the opening being curved to guide said web onto the column and over the hubs of any immediately adjacent webs in said tier.

23. A display stand structure comprising a base having a vertical column, at least one tier of radially outwardly and upwardly tilted transparent housings carried by said column, each said tier comprising a plurality of interfitting units, each unit having a web with one of said housings on each end thereof, each housing having a downwardly and rearwardly sloping lower wall, a hub carried by each web midway between said housings, and an opening formed through the rear portion of said sloping lower wall of each said housing to permit egress of material from said housing whereby stacking said hubs and interfitting said webs will form said tier.

* * * * *